US007140841B2

(12) United States Patent
Goetzfried et al.

(10) Patent No.: US 7,140,841 B2
(45) Date of Patent: Nov. 28, 2006

(54) ROTOR BLADE CONNECTING ARRANGEMENT FOR A TURBOMACHINE

(75) Inventors: Eduard Goetzfried, Allersberg (DE); Heinz-Dieter Tremmel, Nuremberg (DE)

(73) Assignee: Alstom Technology Ltd., Baden (CH)

( * ) Notice: Subject to any disclaimer, the term of this patent is extended or adjusted under 35 U.S.C. 154(b) by 66 days.

(21) Appl. No.: 10/936,575

(22) Filed: Sep. 9, 2004

(65) Prior Publication Data

US 2005/0111983 A1 May 26, 2005

(30) Foreign Application Priority Data

Sep. 12, 2003 (DE) ..... 103 42 207

(51) Int. Cl.
*F01D 5/22* (2006.01)

(52) U.S. Cl. ..... 416/191; 416/196 R

(58) Field of Classification Search ..... 415/119; 416/190, 191, 195, 196 R, 193 R, 193 A
See application file for complete search history.

(56) References Cited

U.S. PATENT DOCUMENTS 3,990,813 A 11/1976 Imai et al.
4,257,743 A * 3/1981 Fujii ..... 416/196 R
4,407,634 A * 10/1983 Tones ..... 416/196 R

FOREIGN PATENT DOCUMENTS

DE 3517283 A * 11/1986
DE 35 17 283 C2 5/1988
DE 35 17 283 A1 11/1988

OTHER PUBLICATIONS

Search Report from DE 103 42 207.2 (Nov. 24, 2003).

* cited by examiner

*Primary Examiner*—Richard A. Edgar
(74) *Attorney, Agent, or Firm*—Cermak & Kenealy, LLP; Adam J. Cermak

(57) ABSTRACT

A connecting arrangement for rotor blades of a turbomachine includes projections (2), which extend in circumferential direction (3), are rigidly connected in pairs to a rotor blade and are respectively supported on the adjacent projection (2) by means of a pressure body (7). Each pressure body (7) has, on a securing face (8), a securing contour (10) which protrudes into an acceptance feature (11) of the associated projection (2) and is supported in it. Each pressure body (7) has, on a support face (9), a plane support surface (13) which has area support on a plane mating support surface (14) of the adjacent projection (2). In order to also improve the support in the case of different rotational angles of the projections (2), the securing contour (10) of the pressure body (7) is configured as a spherical segment. The associated acceptance feature (11) is likewise configured as a spherical segment whose radius (R) is of the same magnitude as the radius (R) of the spherical segment of the securing contour (10).

8 Claims, 3 Drawing Sheets

ROTOR BLADE CONNECTING ARRANGEMENT FOR A TURBOMACHINE

This application claims priority under 35 U.S.C. § 119 to German application number 103 42 207.2, filed 12 Sep. 2003, the entirety of which is incorporated by reference herein.

BACKGROUND OF THE INVENTION

1. Field of the Invention

The present invention relates to a connecting arrangement for rotor blades of a turbomachine.

2. Brief Description of the Related Art

A rotor blade connecting arrangement of the type mentioned at the beginning is known from DE 35 17 283 C2. In this arrangement, projections are provided which extend in the circumferential direction, are rigidly connected in pairs to a rotor blade and are respectively supported by at least one pressure body on the projection which is adjacent in the circumferential direction. In this arrangement, each pressure body has a securing contour on a securing face which faces toward the associated projection, which securing contour protrudes into an acceptance feature configured on the associated projection and is supported, in the circumferential direction and transverse to it, in the acceptance feature. In addition, each pressure body has a plane support surface on a support face which faces toward the adjacent projection, which support surface has area support on a plane mating support surface associated with an adjacent projection. In the known rotor blade connecting arrangement, the securing contours of the pressure bodies are respectively configured as a cone. The associated acceptance features are likewise configured as a cone, the cone of the securing contour having, however, a conicity different from that of the cone of the acceptance feature. This achieves the effect that compensation can be provided for manufacturing tolerances of the seating surface and the pressure body due to slight plastic deformations at the outer edge of the cone acceptance feature and the cone securing contour. The mating support surface, on which the support surface of the pressure body is supported, can be formed, in a development of the known rotor blade connecting arrangement, by the support surface of a mating pressure body which has the same structure as the pressure body.

The known rotor blade connecting arrangement functions in an optimum manner if, during operation of the turbomachine, only relative motions extending parallel to the support surface occur. The support surface can then slide on the mating support surface. In practice, however, it is not only parallel-directed relative motions which occur between the mutually supporting or mutually connecting projections. Particularly when a turbine is being run up or run in certain low-load operating phases, for example during windage in the last turbine stage, twisting and torsion of the rotor blades, and therefore of the projections, can occur. This leads, in particular, to increased vibration loading on the blade connecting arrangement. Rotational motions between the projections, however, lead to a line or point loading of the respective pressure body acceptance feature, which can lead to a brittle fracture of the hard pressure body or to cracking of the pressure body seat.

SUMMARY OF THE INVENTION

The invention includes the aspect of providing an improved embodiment for a rotor blade connecting arrangement of the type mentioned at the beginning, which embodiment makes it possible to compensate for manufacturing tolerances, clearances, elastic deformation and similar factors by an exclusively sliding motion.

A principle of the present invention is based on the general idea of configuring the securing contour of the pressure body and the contour of the associated acceptance feature as complementary spherical segments. On the one hand, this construction achieves the effect that the pressure body has area support on the associated projection. On the other hand, a ball-head support of the pressure body on the associated projection is configured by means of this measure, which ball-head support makes it possible for the pressure body to rotate its support surface around the center of the sphere. In the case of larger rotational adjustment motions of the projections or of the rotor blades during, for example, run-up to the rated speed, compensation can be provided for these relative motions by the rotatably supported pressure bodies, so that an area force transmission can always be achieved between the mutually supporting or mutually connecting projections. With the rotor blade connecting arrangement according to the invention, changing angular positions of the rotor blades or of the projections effect an autonomous adjustment of the movably supported pressure bodies. Stress peaks are avoided by this means. During operation at rated speed, on the other hand, the frictional damping due to the area contact is fully effective. There are no high-frequency tilting motions.

In a preferred embodiment, the center point of the spherical segment of the securing contour is the center of a sphere, whereas the support surface is circular and its center point is the center of a circle. The pressure body is then designed in such a way that a straight line, which extends through both the center of the circle and the center of the sphere, is at right angles to the support surface plane. In other words, the pressure body is axisymmetrically constructed relative to this straight line. More or less arbitrary compensation can be provided by this configuration for spatially oriented rotations and twists of the projections or the rotor blades.

The mating support surface, which is associated with the adjacent projection and on which the support surface of the pressure body has area support, can for example be configured directly on the end face of the adjacent projection.

As an alternative, this mating support surface can be configured on an abutment element, which is fastened to an end face of the adjacent projection. It is likewise possible to form the mating support surface by means of the support surface of a mating pressure body, which is secured on the adjacent projection. Pressure body and mating pressure body can, fundamentally, have the same structure. An embodiment in which the mating pressure body cannot execute any tumbling motions relative to the normal direction of its mating support surface is, however, preferred. In this way, all the compensation motions are exclusively executed by the spherically supported pressure body. This achieves the effect that in the case of corresponding rotations of the projections, the movable pressure body always returns independently to its initial position.

A variant is preferred for the mating pressure body in which both the securing contour of the mating pressure body and the associated acceptance feature are configured as a cone or as a truncated cone, both truncated cones having the same conicity. In this way, on the one hand, area contact of the mating pressure body with the associated projection occurs. On the other hand, the mating pressure body is rigidly fixed, in terms of its longitudinal central axis, on the projection and it can therefore be used as an abutment for the pressure body supported on it.

Further important features and advantages of the rotor blade connecting arrangement according to the principles of the present invention follow from the the drawings and the associated figure description which uses the drawings.

BRIEF DESCRIPTION OF THE DRAWINGS

Preferred exemplary embodiments of the invention are shown in the drawings and are explained in more detail in the following description, the same designations referring to the same or similar or functionally equivalent components. Diagrammatically in each case.

DETAILED DESCRIPTION OF THE PREFERRED EMBODIMENTS

Figure 1:
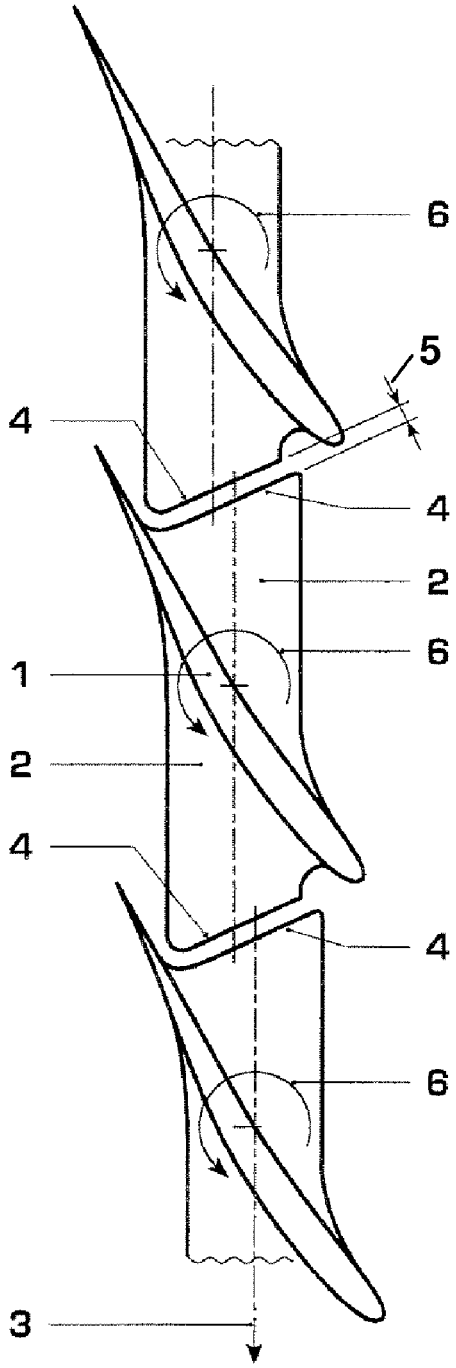
FIG. 1 shows a plan view onto a blading row excerpt in the nonoperating condition.
Figure 5:
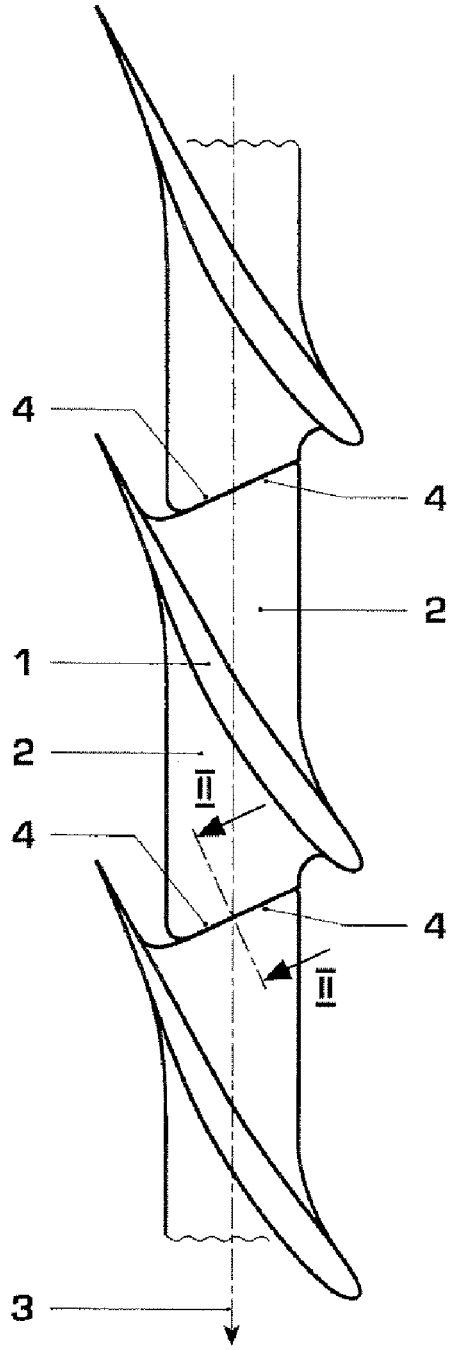
FIG. 5 shows a plan view onto a blading row excerpt in the operating condition.

Corresponding to FIGS. 1 and 5, rotor blades 1 of a turbomachine, otherwise not shown, are respectively equipped with two projections 2, located on different sides of the blade aerofoil. In this arrangement, these projections 2 extend in a circumferential direction 3, which is indicated by an arrow and in which direction the rotor blades 1 circulate during operation of the turbomachine. The projections 2 are rigidly connected to the respective rotor blade 1 and can, in particular, form an integral constituent of the respective rotor blade 1. The projections 2 are expediently designed in the form of support fins, which have aerodynamic profiles and are, as a rule, arranged between the radial ends of the rotor blades 1. Fundamentally, the projections 2 can also be designed as cover plates or shrouds, which are arranged at the radially outer ends of the rotor blades 1. Fundamentally, the projections 2 can also be different connecting elements.

In the nonoperating condition, as shown in FIG. 1, a gap 5 is configured in the circumferential direction 3 between mutually facing end faces 4 of adjacent projections 2. In the operating condition, as shown in FIG. 5, the centrifugal forces effect an unwinding of the rotor blades 1, corresponding to an arrow 6 plotted in FIG. 1, so that the gap 5 closes.

Figure 2:
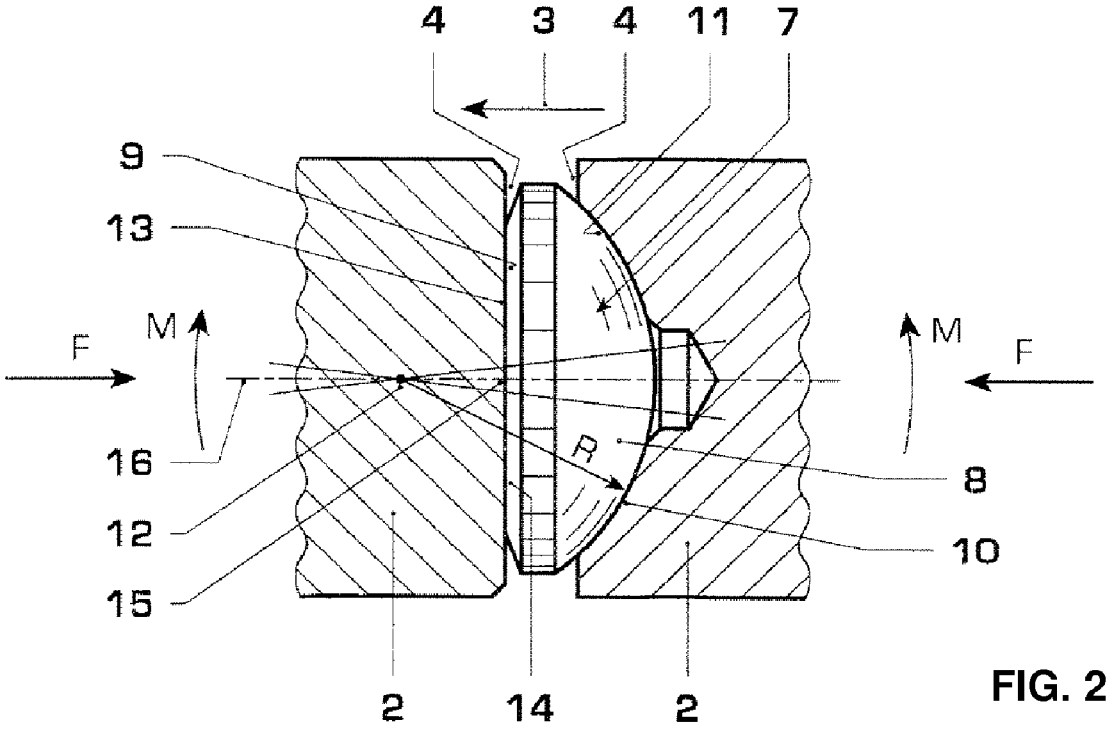
FIG. 2 shows a section, along a section line II—II in FIG. 1*b*, through two mutually connected projections.
Figure 3:
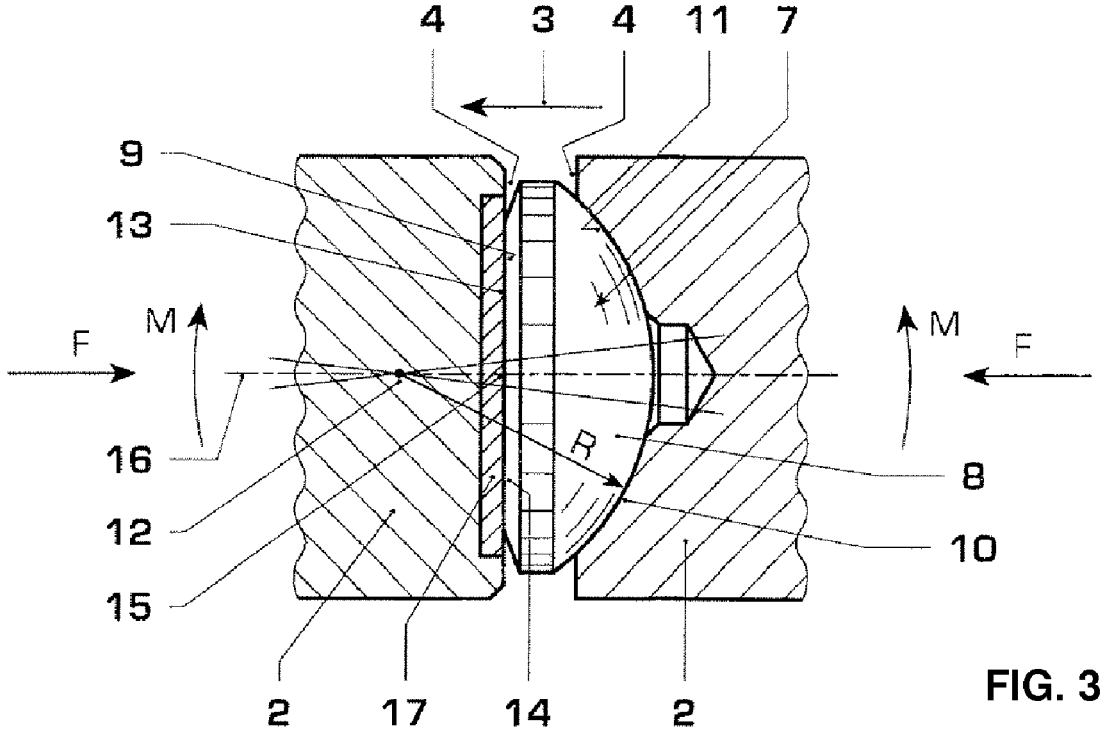
FIG. 3 shows a sectional view, as in FIG. 2, but for a different embodiment.
Figure 4:
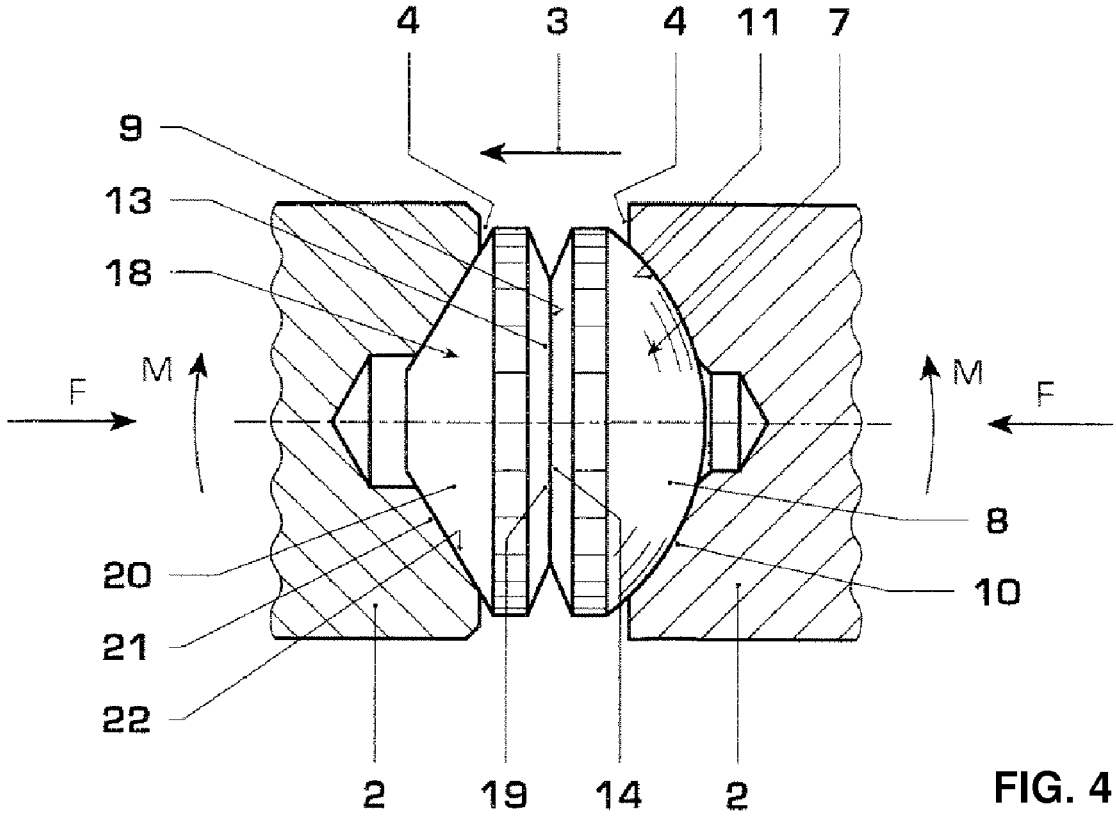
FIG. 4 shows a sectional view, as in FIG. 2, but for a further embodiment.

As a departure from FIGS. 1 and 5, however, the projections 2 are not supported directly on one another on their end faces 4 but, indirectly, by means of at least one pressure body 7 in each case (see FIGS. 2 to 4). In order to simplify the representation in FIGS. 1 and 5, however, these pressure bodies 7 are not reproduced.

In the sectional views of FIGS. 2 to 4, the mutually opposite end sections of a pair of projections 2, which support one another at least during operation of the turbomachine, are respectively shown sectioned, whereas the pressure body 7 arranged in this region is not shown in section. It is clear that the sectional representation of FIGS. 2 to 4 can also correspond to a section which is rotated by 90° about the section line II in the drawing plane of FIG. 5.

Corresponding to FIGS. 2 to 4, each pressure body 7 has a spherical securing face 8 and a plane support face 9. Whereas the securing face 8 faces toward the projection 2, with which the respective pressure body 7 is associated (as shown in FIGS. 2 to 4, the right-hand projection 2 in each case), the support face 9 faces in the circumferential direction 3 toward the adjacent projection 2 (therefore, as shown in FIGS. 2 to 4, toward the left-hand projection 2 in each case). A protuberant or protruding securing contour 10 is configured on the securing face 8. The projection 2, which is associated with the pressure body 7, has an acceptance feature 11, into which the securing contour 10 of the pressure body 7 is inserted, on its end face 4. The securing contour 10 therefore protrudes into the acceptance feature 11 and can be supported in it in the circumferential direction 3 and transverse to the circumferential direction 3. According to the invention, the securing contour 10 is now configured as a spherical segment. In a manner complementary to this, the acceptance feature 11 is likewise configured as a spherical segment. In this arrangement, the spherical segments have the same radius R, by which means the spherical segment of the securing contour 10 comes into area contact with the spherical segment of the acceptance feature 11. At the same time, the pressure body 7 according to the invention forms, by this means, a type of ball joint, which is movably supported on the associated projection 2 about a center 12 of the sphere in a linkage socket. In this arrangement, the linkage socket is formed by the acceptance feature 11. In order to optimize the stress condition in the contact region, the radii of the pressure body 7 and the acceptance feature 11 can also differ slightly from one another.

In addition, the pressure body 7 has a plane support surface 13 on its support face 9. As may be seen from FIGS. 2 to 4, the pressure body 7 is supported, by means of its support surface 13, on a mating support surface 14, at least during operation of the turbomachine, which mating support surface 14 is associated with the adjacent support fin 2. The mating support surface 14 is also of plane design, so that the support surfaces 13 and 14 have area contact with one another.

As can be seen from FIGS. 2 to 4, the pressure body 7 according to the invention can transmit comparatively large forces F in the circumferential direction 3 between the mutually connected projections 2. Due to the friction, furthermore, coupling torques M can also be transmitted between adjacent rotor blades 1 via the mutually connected projections 2. Because of the movable support arrangement of the pressure body 7 on the associated projection 2, compensation can also be provided for rotational adjustments or twists between adjacent rotor blades 1 or between mutually supported projections 2. Because of the support arrangement proposed for the pressure body 7, the area contact between the support surfaces 13 and 14 is maintained in this arrangement, as is the area contact between the securing contour 10 and the acceptance feature 11.

The rotor blade connecting arrangement according to the invention can therefore provide compensation for the rotational motions and different angular positions of the projections 2 possibly occurring in operation, particularly during start-up and run-down, without excessively large elastic or even plastic deformations occurring in the process.

The geometry of the pressure body 7 is expediently selected in such a way that the support surface 13 has a circular configuration, the circle having a center 15. The spherical securing contour 10 is then matched to the plane support surface 13 in such a way that a straight line 16, which extends through both the center 15 of the circle and the center 12 of the sphere, is at right angles to the plane of the support surface 13. This makes the pressure body 7 axisymmetric, so that the support arrangement achieved by this means is equally effective in all spatial directions.

In the embodiment shown in FIG. 2, the mating support surface 14 is configured directly on the end face 4 of the adjacent projection 2.

As an alternative to this, the mating support surface 14 can, according to the embodiment shown in FIG. 3, also be configured on a special abutment element 17. This abutment element 17 is fastened to the end face 4 of the adjacent projection 2, in particular by brazing or welding. In the case of the embodiment shown here, the abutment element 17 is configured as a plate, which is inserted in the end face 4 of the adjacent projection 2 and arranged so that it is countersunk into it.

Corresponding to the embodiment shown in FIG. 4, the mating support surface 14 can also, however, be configured on a mating pressure body 18. This essentially involves the construction presented in DE 3517283. The mating pressure body 18 has—like the pressure body 7—a support face 19 with a plane support surface, which forms the mating support surface 14. In addition, the mating pressure body 18 is also equipped with a securing face 20, on which a securing contour 21 is configured. The securing contour 21 of the mating pressure body 18 is also inserted in a corresponding acceptance feature 22, which is configured in the adjacent projection 2. The shaping of the securing contour 21 of the mating pressure body 18 and the acceptance feature 22 interacting with it are then matched to one another in such a way that the mating support surface 14 of the mating pressure body 18 is spatially fixed relative to the associated projection 2. This is achieved by configuring the securing contour 21 as a cone whereas, matching it, the associated acceptance feature 22 is also configured as a cone, which has the same conicity as the cone of the securing contour 21. In consequence, the securing contour 21 of the mating pressure body 18 is in area contact with the acceptance feature 22. Although it is fundamentally still possible to rotate the mating pressure body 18 about its longitudinal central axis, the plane of its mating support surface 14 remains, however, invariant relative to the associated projection 2.

In order to protect from wear the plane support surfaces 13 of the pressure body 7 and the interacting mating support surfaces 14, the support surfaces 13 and/or the mating support surfaces 14 can be provided with a low-friction coating (not shown). At the same time, the frictional forces arising in the plane of the support surfaces 13 and of the mating support surfaces 14 can be reduced by this means.

For wear reduction, provision can be made, additionally or alternatively, to configure the pressure body 7 and the mating pressure body 18 in a suitable hard metal, at least in a section exhibiting the support surface 13 and the mating support surface 14. Likewise, the abutment element 17 shown in FIG. 3 can be manufactured from a suitable hard metal.

LIST OF DESIGNATIONS

1 Rotor blade
2 Projection/support fin
3 Circumferential direction
4 End face of 2
5 Gap
6 Torque
7 Pressure body
8 Securing face of 7
9 Support face of 7
10 Securing contour of 8
11 Acceptance feature
12 Center of sphere
13 Support surface of 9
14 Mating support surface
15 Center of circle
16 Straight line
17 Abutment element
18 Mating pressure body
19 Support face of 18
20 Securing face of 18
21 Securing contour of 20
22 Acceptance feature
R Radius
F Force
M Coupling torque While the invention has been described in detail with reference to preferred embodiments thereof, it will be apparent to one skilled in the art that various changes can be made, and equivalents employed, without departing from the scope of the invention. Each of the aforementioned documents is incorporated by reference herein in its entirety.

What is claimed is:

1. A connecting arrangement for rotor blades of a turbomachine, the connecting arrangement comprising:

a rotor blade;

at least one pressure body;

projections extending in a circumferential direction rigidly connected in pairs to the rotor blade, the projections being configured and arranged so that at least during operation of the turbomachine the projections are each supported by said at least one pressure body on a projection circumferentially adjacent to each projection;

wherein each projection includes an acceptance feature;

wherein each pressure body has a securing face with a securing contour which securing face faces toward an associated projection, which securing contour protrudes into the acceptance feature on an associated projection and the securing contour is circumferentially and transversely supported in the acceptance feature;

wherein each pressure body includes a support face including a plane support surface, which plane support surface faces toward an adjacent projection, said adjacent projection including a plane mating surface, which plane support surface has, at least during operation of the turbomachine, area support on said plane mating surface of said adjacent projection;

wherein at least one pressure body includes a securing contour comprising a spherical segment, said at least one pressure body associated with each pair of mutually supporting projections; and wherein an acceptance feature associated with said spherical segment comprises a spherical segment a radius of which is at least approximately of the same magnitude as a radius of the spherical segment of the securing contours;

wherein each said adjacent projection includes an end face, and wherein said plane mating surface is positioned directly on said end face of said adjacent projection.

2. The rotor blade connecting arrangement as claimed in claim 1, wherein said plane mating surface is formed by the support surface of a mating pressure body which, with its securing contour, protrudes into an acceptance feature in an adjacent projection.

3. The rotor blade connecting arrangement as claimed in claim 2, wherein the securing contour of the mating pressure body comprises a cone, the associated acceptance feature comprising a cone whose conicity is of equal magnitude to the conicity of the cone of the securing contour.

4. The rotor blade connecting arrangement as claimed in claim 1, wherein an adjacent projection includes an end face, and further comprising:

an abutment element fastened to the end face of the adjacent projection.

5. The rotor blade connecting arrangement as claimed in claim 1, wherein the support surface, the mating support surface, comprise low friction means and wear-resistant means.

6. A connecting arrangement for rotor blades of a turbomachine, the connecting arrangement comprising:

a rotor blade;

at least one pressure body;

projections extending in a circumferential direction rigidly connected in pairs to the rotor blade, the projections being configured and arranged so that at least during operation of the turbomachine the projections are each supported by said at least one pressure body on a projection circumferentially adjacent to each projection;

wherein each projection includes an acceptance feature;

wherein each pressure body has a securing face with a securing contour which securing face faces toward an associated projection, which securing contour protrudes into the acceptance feature on an associated projection and the securing contour is circumferentially and transversely supported in the acceptance feature;

wherein each pressure body includes a support face including a plane support surface, which plane support surface faces toward an adjacent projection, said adjacent projection including a plane mating surface, which plane support surface has, at least during operation of the turbomachine, area support on said plane mating surface of said adjacent projection;

wherein at least one pressure body includes a securing contour comprising a spherical segment, said at least one pressure body associated with each pair of mutually supporting projections;

wherein an acceptance feature associated with said spherical segment comprises a spherical segment a radius of which is at least approximately of the same magnitude as a radius of the spherical segment of the securing contour;

wherein said plane mating surface is formed by the support surface of a mating pressure body which, with its securing contour, protrudes into an acceptance feature in an adjacent projection; and wherein the securing contour of the mating pressure body comprises a cone, the associated acceptance feature comprising a cone whose conicity is of equal magnitude to the conicity of the cone of the securing contour.

7. The rotor blade connecting arrangement as claimed in claim 6, wherein an adjacent projection includes an end face, and further comprising:

an abutment element fastened to the end face of the adjacent projection.

8. The rotor blade connecting arrangement as claimed in claim 6, wherein the support surface, the mating support surface, comprise low friction means and wear-resistant means.

* * * * *